US011739532B1

(12) United States Patent
Robida

(10) Patent No.: US 11,739,532 B1
(45) Date of Patent: Aug. 29, 2023

(54) OFF-RIDGE ROOF VENTILATION DEVICE

(71) Applicant: MARCO INDUSTRIES INC., Tulsa, OK (US)

(72) Inventor: Albert Robida, Apopka, FL (US)

(73) Assignee: MARCO INDUSTRIES INC., Tulsa, OK (US)

( * ) Notice: Subject to any disclaimer, the term of this patent is extended or adjusted under 35 U.S.C. 154(b) by 194 days.

(21) Appl. No.: 16/709,153

(22) Filed: Dec. 10, 2019

Related U.S. Application Data

(60) Provisional application No. 62/864,761, filed on Jun. 21, 2019.

(51) Int. Cl.
*E04D 13/17* (2006.01)
*F24F 7/02* (2006.01)

(52) U.S. Cl.
CPC ..... *E04D 13/174* (2013.01); *F24F 7/02* (2013.01)

(58) Field of Classification Search
CPC ..... E04D 13/17; E04D 13/174; E04D 13/147; E04D 13/1476; E04D 13/0325; F24F 7/02; F24F 7/025; B60H 1/245; B60H 1/262
USPC ..... 454/365
See application file for complete search history.

(56) References Cited

U.S. PATENT DOCUMENTS 1,983,979 A * 12/1934 Graham ..... B60H 1/00464 454/117
2,300,842 A 11/1942 Leslie
2,447,472 A 8/1948 Donley
2,470,201 A * 5/1949 Werner ..... F24F 7/02 454/275
2,490,220 A * 12/1949 Leslie ..... E04D 13/17 454/366
2,551,223 A 5/1951 Schneider
3,403,616 A 10/1968 Nelson
4,297,818 A 11/1981 Anderson
4,545,291 A * 10/1985 Kutsch et al. ..... A01K 1/0058 454/365
4,555,982 A 12/1985 Goubaud
4,730,552 A 3/1988 Murray
5,050,489 A * 9/1991 Mankowski ..... E04D 13/17 454/365
6,202,372 B1 3/2001 Powell
6,308,473 B1 10/2001 Auck
6,390,914 B1 5/2002 O'Hagin et al.

(Continued)

*Primary Examiner* — Steven B McAllister
*Assistant Examiner* — Charles R Brawner
(74) *Attorney, Agent, or Firm* — Dorsey & Whitney LLP

(57) ABSTRACT

An off-ridge roof ventilation device for placing on an opening of a roof deck. The ventilation device comprises an elongated main hood with a curved shape. The right end of the main hood is closed by a right-side panel, and the left end of the main hood is closed by a left-side panel. The main hood comprises a perforated top face and a venting opening on a bottom face. A throat panel is placed on the bottom face of the main hood in a manner to reduce the venting opening. A perforated interior panel is placed between the top face of the main hood and the throat panel to eliminate wind driven rain and/or snow even in high wind situations. The perforations are preferably designed as mini-louvers, wherein the mini-louvers of the main hood and the mini-louvers of the throat panel comprise the same shape and count the same number.

20 Claims, 6 Drawing Sheets

(56) References Cited

U.S. PATENT DOCUMENTS

| | | | | |
|---|---|---|---|---|
| 6,875,102 | B2 | 4/2005 | Achen | |
| 7,044,852 | B2 | 5/2006 | Horton | |
| 7,338,359 | B2 | 3/2008 | Grossman et al. | |
| 8,292,707 | B2 | 10/2012 | Grisham et al. | |
| 9,243,813 | B2 | 1/2016 | Mantyla et al. | |
| 9,447,583 | B2 | 9/2016 | Tovmasyan | |
| 9,557,072 | B2 | 1/2017 | Tolinski et al. | |
| 9,822,532 | B2 | 11/2017 | Sherry | |
| 2003/0153262 | A1* | 8/2003 | Mantyla et al. | F24F 7/02 454/367 |
| 2005/0233691 | A1* | 10/2005 | Horton | E04D 13/17 454/366 |
| 2006/0223437 | A1 | 10/2006 | O'Hagin | |
| 2007/0049190 | A1* | 3/2007 | Singh | E04D 13/17 454/365 |
| 2009/0113823 | A1* | 5/2009 | Osborne | E04D 13/17 52/198 |
| 2012/0304567 | A1 | 12/2012 | Baker, IV et al. | |
| 2017/0146253 | A1* | 5/2017 | Mantyla et al. | F24F 7/02 |
| 2020/0011554 | A1* | 1/2020 | Chang | F24F 7/02 |

* cited by examiner

OFF-RIDGE ROOF VENTILATION DEVICE

CROSS-REFERENCE TO RELATED APPLICATIONS

This application claims the benefit of U.S. Provisional Pat. Application Serial No. 62/864,761, filed on Jun. 21, 2019, which is incorporated by reference herein in its entirety.

FIELD OF THE INVENTION

The present invention relates generally to ventilation devices, and more particularly, to an off-ridge roof ventilation device for placing on an opening of a roof deck.

BACKGROUND OF THE INVENTION

Ventilation is the intentional circulation of outdoor and indoor air into and out of enclosed spaces, to dilute and displace indoor pollutants and increase thermal comfort and dehumidification.

Natural ventilation is the intentional passive circulation of outdoor and indoor air into and out of an enclosed space, such as an inside of a building. The passive circulation occurs by air flowing from the outside into the inside of the building and vice versa through planned openings of a building without moving parts. Natural ventilation relies on diffusion, wind pressure, or the stack effect. The internal heat of a building gains by the heat from people inside the building, resulting in a temperature difference between the interior and exterior of the building. The temperature difference creates a pressure difference between the indoor and outdoor space of the building making the air flow from the outdoor space to the indoor space of the building and vice versa.

A roof is the top covering of a building, supported by the walls of the building. The roof protects the interior of the building against rain, snow, sunlight, extreme temperatures, and wind. Roofs are normally either flat or pitched. The pitch refers to the steepness or slope of the roof. Generally, pitched roofs are configured to redirect or prevent accumulation of water and/or snow. Thus, the pitch is typically greater in areas of high rain and/or snowfall.

State of the art ventilation devices are usually mounted on a roof and have a low profile to minimize damage from high winds. In case of a pitched roof, the ventilation device is often placed away from a ridge of the roof to minimize damage from high winds. Such ventilation devices are known as off-ridge roof ventilation devices.

An off-ridge roof ventilation device is usually positioned over an opening in the roof sheathing leading to an attic or other space of the building. The opening of the roof deck is cut from the roof sheathing, wherein the location of the opening of the roof deck is usually at least 12″ off the lower roof edge. The off-ridge roof ventilation device is normally configured to cover the opening of the roof deck completely and seal the opening of the roof deck without blocking airflow.

State of the art off-ridge roof ventilation devices usually comprise a hood with a front opening to allow circulation of outdoor and indoor air through an opening in the roof deck and the front opening. The front opening is usually covered by a screen to prevent small animals or debris from entering the off-ridge roof ventilation device. Such off-ridge roof ventilation devices are disadvantageous in high wind situations, because rain and/or snow can pass through the front opening and reach the interior of the building through the opening in the roof deck.

Accordingly, there is an established need for an off-ridge roof ventilation device, which completely eliminates wind driven rain and/or snow even in high wind situations. The off-ridge roof ventilation device should preferably also be aerodynamic and prevent small animals and/or debris from entering the ventilation device without a need for a screen.

SUMMARY OF THE INVENTION

The present invention consists of an off-ridge roof ventilation device for placing on an opening of a roof deck, the off-ridge roof ventilation device comprising an outer hood having a perforated top face and a venting opening on a bottom face. The venting opening is intended to face an opening on a roof deck. A throat or water-retaining panel is arranged on the bottom face of the main hood in a manner to reduce the venting opening. A perforated interior panel is arranged between the top face of the main hood and the throat panel, and is configured to allow inside air venting while retaining outside rain and directing the rain towards the throat panel.

The interior panel along with the aerodynamic hood completely eliminates wind driven rain even in high wind situations. No front opening, no screen, and no exterior baffle are needed. The perforations on the lower portion of the hood allow the air to flow through the ventilation device. The ventilation device is maintenance free and totally resistant to wind uplift and wind driven rain. Without the need for having an open front as is typically known in the art, such a structure provides superior resistance to wind driven rain by not allowing wind to enter the ventilation device.

In a first implementation of the invention, the off-ridge roof ventilation device comprises a main hood configured to cover an opening on a roof deck. The main hood is provided with perforations and an open bottom. A throat panel is arranged on the open bottom of the main hood and is configured to partially cover the open bottom of the main hood leaving a venting opening in the open bottom of the main hood, the venting opening configured to be arranged over the opening on the roof deck. A perforated interior panel is arranged between the top face of the main hood and the throat panel.

In a second aspect, the throat panel can extend from a front edge of the main hood towards a rear edge of the main hood, and the venting opening of the main hood can extend from a rear edge of the throat panel to the rear edge of the main hood.

In another aspect, the throat panel can include an interior baffle configured to at least partially block outside air entering through the perforations of the main hood from flowing towards the venting opening of the main.

In another aspect, the interior baffle may extend from the rear edge of the throat panel.

In another aspect, a left side of the main hood may be closed by a left-side panel and a right side of the main hood may be closed by a right-side panel.

In another aspect, each one of the left-side panel and right-side panel can include a face portion and a side flange extending from the face portion.

In yet another aspect, the main hood may include a rear portion and a front portion. The front portion of the main hood can be a solid wall comprising the perforations of the main hood, and the rear portion of the main hood can be a non-perforated solid wall.

In another aspect, the rear portion may be convex and rearward-sloped and the front portion may be convex and frontward-sloped.

In another aspect, the rear portion of the main hood can be reinforced with at least one reinforcement rib.

In another aspect, the perforations in the main hood and/or the throat panel can be formed by a roll forming process.

In yet another aspect, the perforations in the main hood and/or the throat panel can be C-shaped and may include front and rear openings.

In another aspect, the perforations in the main hood and/or the throat panel can be formed as louvers.

In another aspect, the roof ventilation device can further include a front flange extending frontward from a front edge of the main hood, the front flange configured to rest on the roof deck.

In yet another aspect, the front flange can include an upward bent to increase rigidity of the front flange and roof ventilation device.

In another aspect, the roof ventilation device can include a rear flange extending rearward from a rear side of the main hood, the rear flange configured to rest on the roof deck.

In another aspect, the perforations of the interior panel can be shaped the same as the perforations of the main hood.

In another aspect, the perforations of the interior panel can be oriented towards the bottom side of the main hood.

In yet another aspect, the perforations of the main hood can be oriented outwardly of the main hood.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
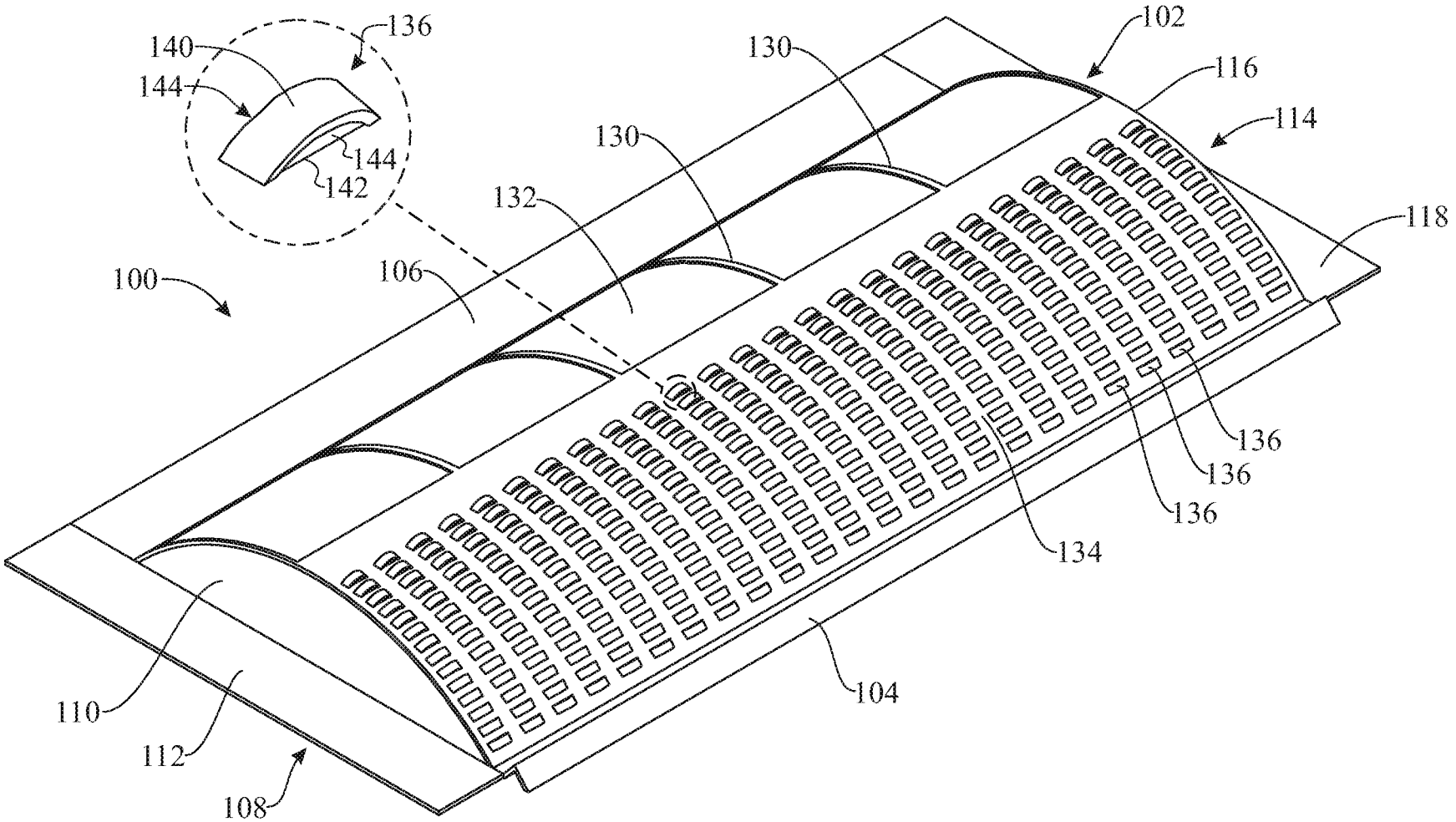
FIG. 1 presents a top front isometric view of an off-ridge roof ventilation device according to an embodiment of the present invention.

The illustration of FIG. 1 presents a top front isometric view of an off-ridge roof ventilation device 100 according to an embodiment of the present invention. The ventilation device 100 is designed for placing on an opening 420 of a roof deck 400 (FIGS. 5 and 6) and comprises a main hood 102. The main hood 102 comprises an elongated body with longitudinal, left and right ends and a curved top surface providing an aerodynamic profile, in a manner that the curved main hood 102 provides superior resistance to wind uplift. In some embodiments, such as the present embodiment, the main hood 102 is formed from a single sheet of metal.

The ventilation device 100 further comprises a front flange 104 extending from a front lateral side of the main hood 102, and a rear flange 106 extending from a rear lateral side of the main hood 102. In some embodiments, the front flange 104 can be designed as a stiffening rib or bend to increase rigidity. The ventilation device 100 further comprises a left-side panel 108 and a right-side panel 114. As shown in FIG. 1 and best shown in FIG. 3, the left side panel 108 is attached to the left end of the main hood 102 in a manner that a face portion 110 of the left side panel 108 closes the left end of the main hood 102; similarly, the right-side panel 114 is attached to the right end of the main hood 102 in a manner that a face portion 116 of the right-side panel 114 closes the right end of the main hood 102.

With continued reference to FIG. 1, the main hood 102 comprises a rear portion 132 and a front portion 134. The rear portion 132 is convex and rearward-sloped, while the front portion 134 is convex and frontward-sloped. The front portion 134 is designed as an integral perforated portion with a plurality or array of perforations 136. The perforations 136 in the front portion 134 can be formed, for instance and without limitation, by a roll forming process. Each perforation 136 is formed as a mini-louver and is dome-shaped or C-shaped, and comprises a curved bridge portion 140 extending over and spaced-apart from a perforation opening 142 and providing a small front opening 144 and a small rear opening 146.

As way of example, the openings of the perforations 136 of the front portion 134 of the hood 102 may have a size of 0.42 inches by 0.12 inches. This size leads to openings with 0.04 square inches. Therefore, the front portion 134 of the hood 102 allows a free air space of 0.04 square inches per opening. Thus, a four-foot ventilation device 100 with 3,026 perforations 136 may provide a total of 121 square inches of free air space.

As best shown in FIG. 1, the rear portion 132 of the main hood 102 is substantially solid and can be reinforced with reinforcement ribs 130. In some embodiments, the reinforcement ribs 130 can be spaced 12″ apart from each other and run the entire height of the rear portion 132 of the main hood 102.

In some embodiments, the left-side panel 108 can be attached to the left end of the main hood 102 of the ventilation device 100 using a Pittsburgh seam. Similarly, the right-side panel 114 can be attached to the left end of the main hood 102 of the ventilation device 100 using a Pittsburgh seam. A ¼″ side flange of the left- and right-side panel 108, 114 can be inserted into the pocket of the Pittsburgh seam. The pocket of the Pittsburgh seam may be filled with a non-hardening seam sealant. The filling of the sealant may be completed prior to the folding of the metal or material used for the main hood 102. The outer edge of the Pittsburgh seam may then be hammered over the left- and right-side panel 108, 114.

Figure 2:
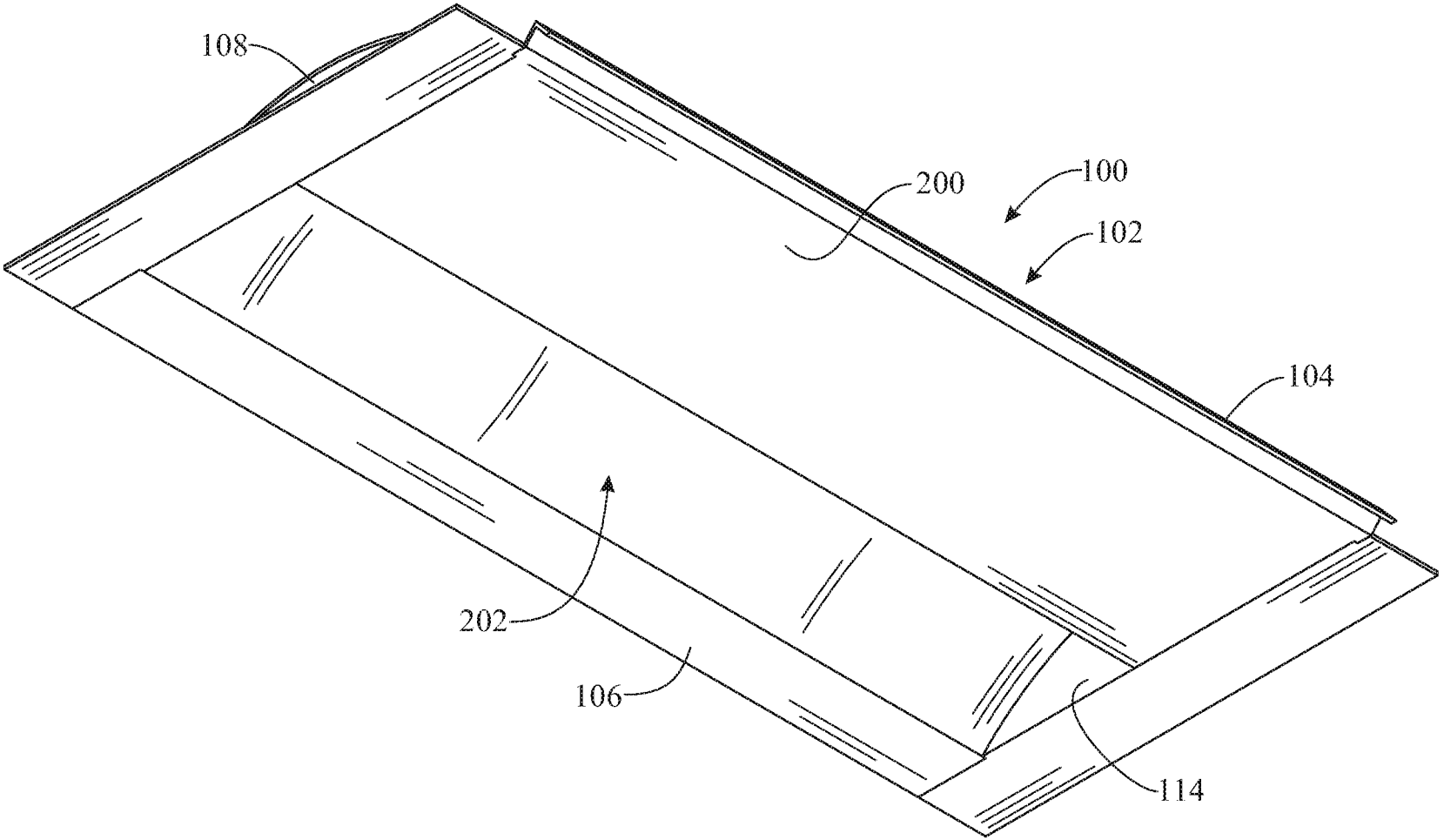
FIG. 2 presents a bottom front isometric view of the off-ridge roof ventilation device of FIG. 1.

The illustration of FIG. 2 presents a bottom front isometric view of the off-ridge roof ventilation device 100 of FIG. 1. According to this illustration, the ventilation device 100 of FIG. 1 also comprises a throat panel 200 and a venting opening 202 arranged on a bottom side of the ventilation device 100 and configured to face the roof opening for purposes that will be hereinafter described. As shown, the throat panel 200 is arranged frontward and parallel to the venting opening 202, and both the throat panel 200 and the venting opening 202 extend across the hood 202, from the left-side panel 108 to the right-side panel 114. The left- and right-side panels 108, 114 can be attached to the throat panel 200 by a clinch lock attachment, for instance and without limitation.

Figure 3:
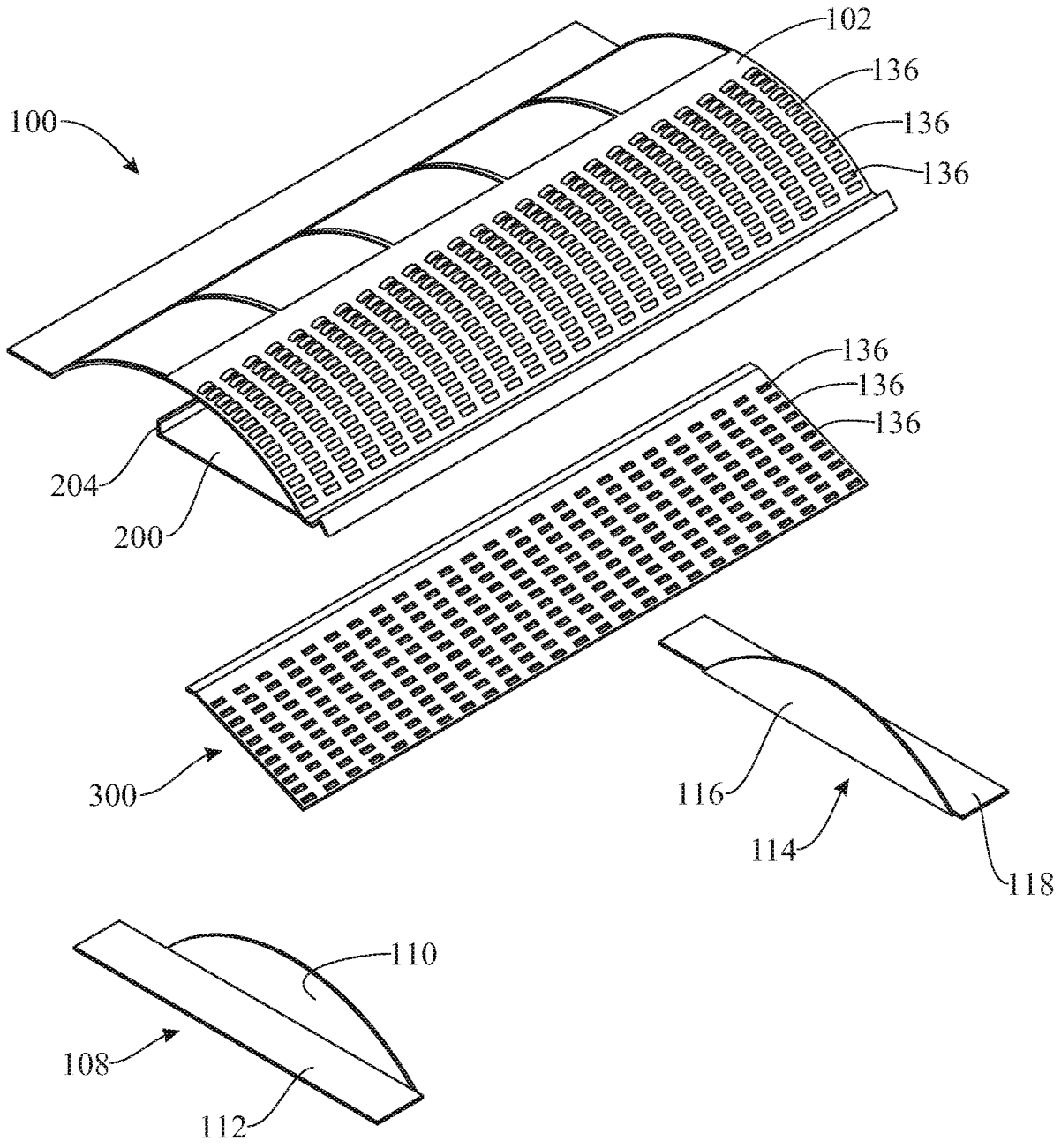
FIG. 3 presents an exploded top front view of the off-ridge roof ventilation device of FIG. 1.

The illustration of FIG. 3 presents an exploded top front view of the off-ridge roof ventilation device 100 of FIG. 1. As shown, the left-side panel 108 includes the aforementioned face portion 110 and a side flange 112 extending from the face portion 110 of the left-side panel 108. Furthermore, the right-side panel 114 includes the aforementioned face portion 116 and a side flange 118 extending from the face portion 116 of the right-side panel 114. The ventilation device 100 further comprises an interior panel 300 with perforations 136. As better shown in FIGS. 5 and 6, the interior panel 300 is arranged beneath the hood 102, and more specifically, between the hood 102 and the throat panel 200 and preferably frontward-sloped. The perforations 136 of the interior panel 300 can have the same shape and size as the perforations 136 of the hood 102, with the bridge portions 140 of the perforations 136 of the interior panel 300 oriented downward instead of upward.

Figure 4:
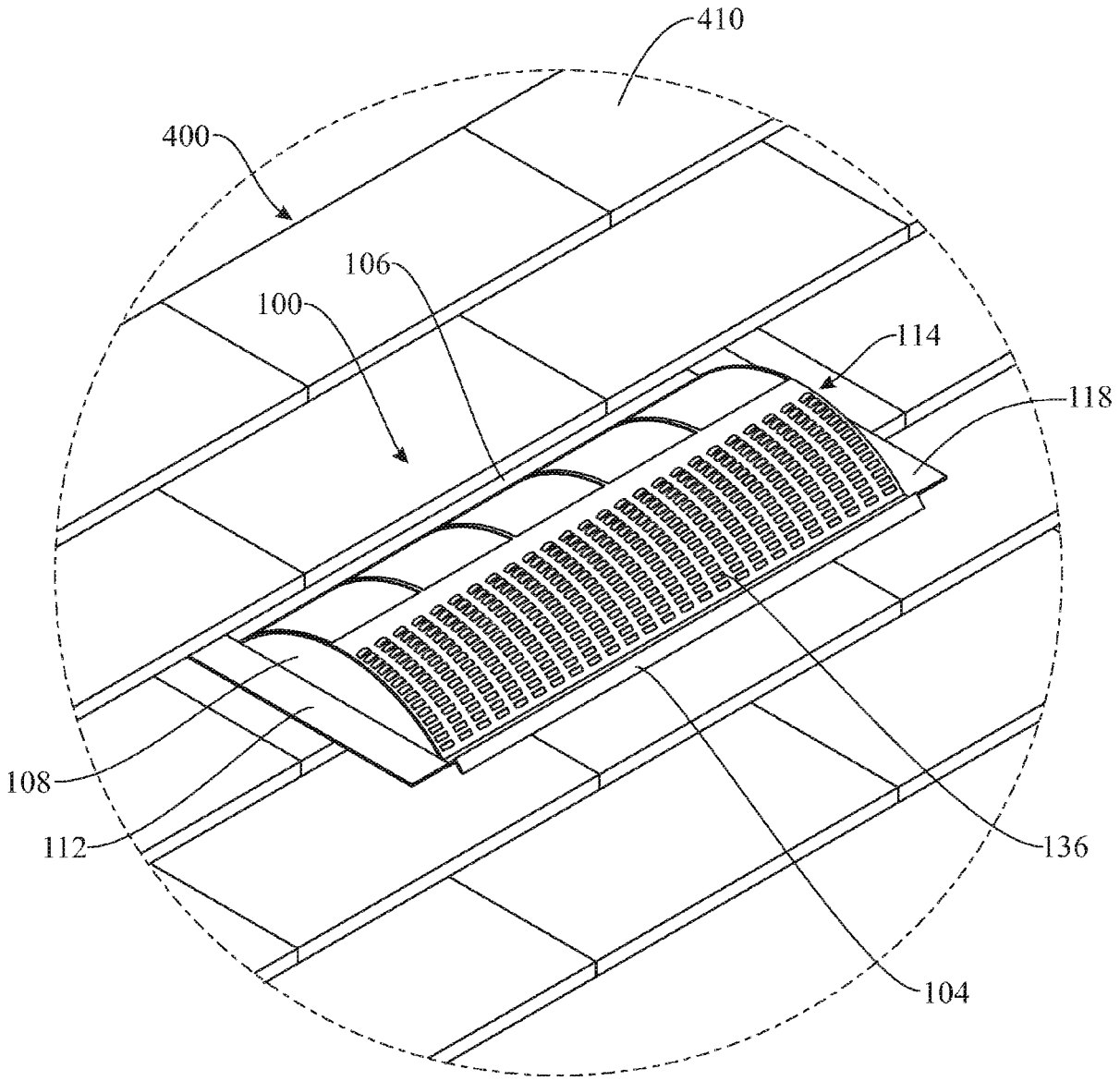
FIG. 4 presents a top front isometric view of the off-ridge roof ventilation device of FIG. 1 mounted on a roof deck according to an illustrative application of the present invention.

The illustration of FIG. 4 presents a top front isometric view of the off-ridge roof ventilation device 100 of FIG. 1 mounted on a roof deck 400 according to an illustrative application of the present invention. In the present illustrative application, the roof deck 400 is covered by shingles 410. The ventilation device 100 can be installed on the roof deck 400 such that the front and rear flanges 104, 106 extend substantially parallel to the ridge (not shown, but otherwise parallel to the roof shingles 410), with the rear flange 106 more proximate to the ridge than the front flange 104. The left- and right-side panels 108, 114 extend substantially perpendicular to the ridge.

Figure 5:
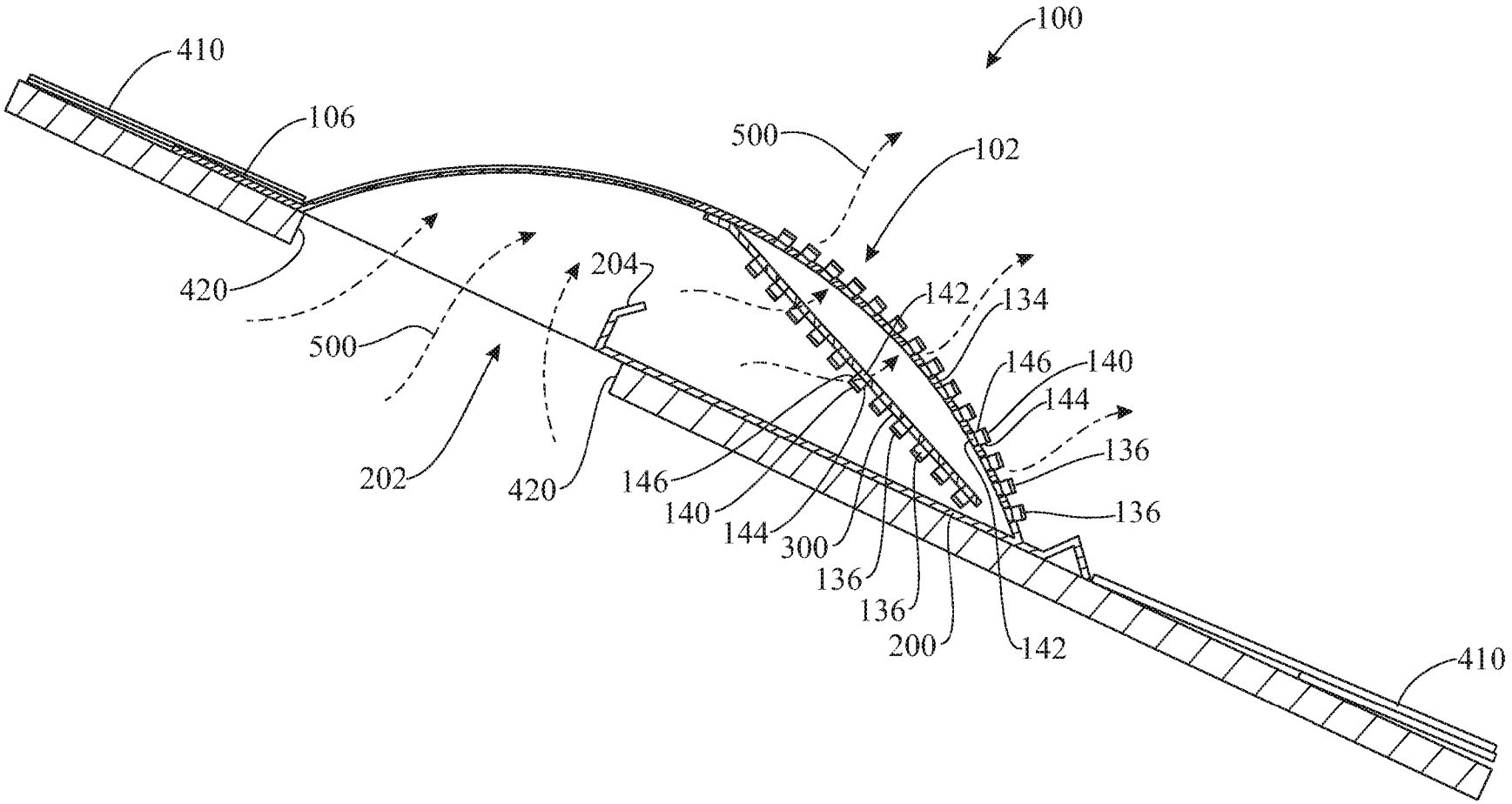
FIG. 5 presents a cross-sectional side elevation view of the off-ridge roof ventilation device and roof deck installation of FIG. 4, showing the off-ridge roof ventilation device venting air from inside roof.
Figure 6:
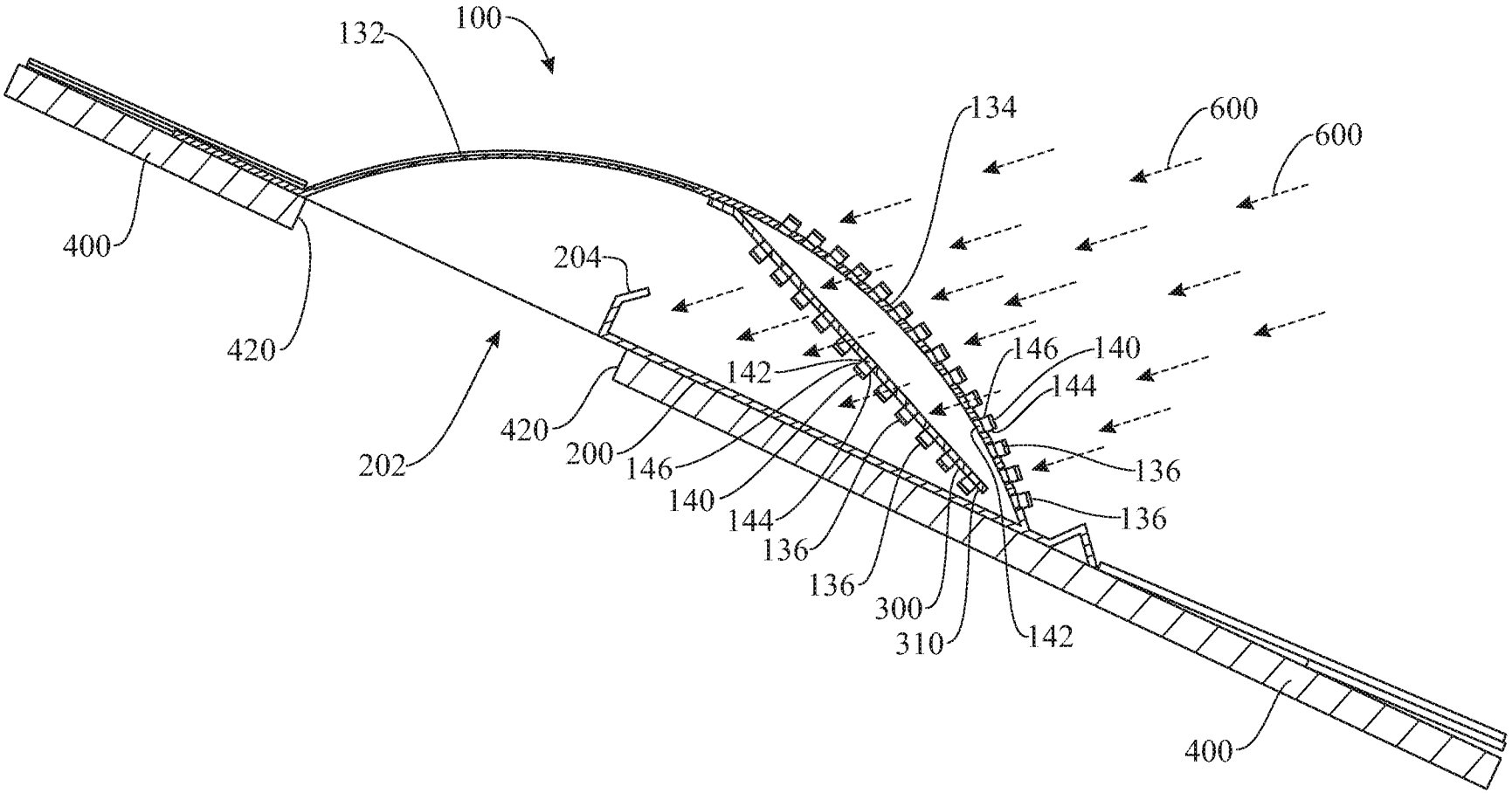
FIG. 6 presents a cross-sectional side elevation view of the off-ridge roof ventilation device and roof deck installation of FIG. 4, showing the off-ridge roof ventilation device stopping wind, rain and other external agents outside the roof from entering the roof.

As shown in FIG. 4 and also in FIGS. 5 and 6, the rear flange 106 can be covered by shingles 410 for a better attachment of the ventilation device 100 on the roof deck 400. In turn, the side flanges 112, 118 of the left- and right-side panels 108, 114 and the front flange 104 can be placed above or adjacent to the shingles 410, i.e. not covered by the shingles 410.

The side flanges 112, 118 of the left- and right-side panels 108, 114 and the main hood 102 provide a sealing of the opening of the roof deck 400 by the ventilation device 100 thereby contributing to comply with best roofing industry practices.

The illustration of FIG. 5 presents a cross-sectional side elevation view of the off-ridge roof ventilation device 100 and roof deck 400 installation of FIG. 4. According to this illustration, the ventilation device 100 is placed on the roof deck 400 and completely covers the opening 420 of the roof deck 400. The opening 420 of the roof deck 400 faces and is in fluid communication with the venting opening 202 of the ventilation device 100. An underside of the throat panel 200 touches the roof deck 400 close to the opening 420 of the roof deck 400 in a large area, giving the ventilation device 100 a strong attachment to the roof deck 400. The air is vented from an interior of a building through the off-ridge roof ventilation device 100, which provides a single piece hood that is aerodynamic in nature with no large openings on the outer surface of the ventilation device 100.

Additionally, as with reference to FIGS. 5 and 3, an interior ridge or baffle 204 can be attached to or extend from the throat panel 200 at its top or rear edge and extend inwardly into the hood 102, such as at a right angle with the throat panel 200. Preferably, the interior baffle 204 has a low profile or height to allow a relatively large air space between the interior baffle 204 and the hood 102. For example, in the depicted embodiment, a full 2.5 inches of free air space can be provided between the interior baffle 204 and the hood 102. With further reference to FIG. 5, venting air 500 flows from the inside of the building to the opening 420 of the roof deck 402 and from there to the venting opening 202 of the venting device 100. Once the air is inside the venting device 100, it is sucked out of the venting device 100 through the perforations 136 of the interior panel 300 and the perforations 136 of the front portion 134 of the main hood 102, and more specifically, through the perforation opening 142, front opening 144 and rear opening 146 of each perforation 136.

In some embodiments, as in the present embodiment, the interior panel 300 can comprise the same number of perforations 136 as on the front portion 134 of the hood 102. As mentioned heretofore, the perforations 136 of the interior panel 300 can be shaped the same as the perforations 136 of the front portion 134 of the main hood 102. However, the perforations 136 of the interior panel 300 can be oriented inwardly to the interior of the venting device 100. In contrast, the perforations 136 of the front portion 134 of the main hood 102 can be oriented outwardly of the interior of the venting device 100.

The illustration of FIG. 6 presents a cross-sectional side elevation view of the off-ridge roof ventilation device 100 and roof deck 400 installation of FIG. 4, in a situation in which outside wind 600 is impacting the installation. The wind 600 can be, for instance, a high-speed wind that strikes frontally on the front portion 134 of the ventilation device 100. The wind 600 can drive rain and/or snow to the front portion 134 of the ventilation device 100. In case the air, rain and/or snow is driven through the openings of the perforations 136 of the front portion 134 of the ventilation device 100, the rain and/or snow will fall on the interior panel 300. The air, rain and/or snow is then further mitigated and/or retained by the interior panel 300; for example, the rain and/or snow flows along the upper, sloped surface of the interior panel 300 to a lower edge of the interior panel 300 and drops on throat panel 200 through a gap 310 which is formed between the lower edge of the interior panel 300 and the throat panel 200. From there the rain and/or snow can flow out of the ventilation device 100 through the first three rows of the perforations 136 of the front portion 134, and any remaining humidity inside the hood 102 can eventually evaporate. The baffle 204 at the top end of the throat panel 200 contributes to retain any air and/or water within the throat panel 200 and prevent it from passing through the venting opening 202 of the ventilation device 100 and the opening 420 of the roof deck 400.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An off-ridge roof ventilation device for placing on an opening of a roof deck, comprising:

a curved main hood configured to cover an opening on a roof deck, the main hood comprising perforations and an open bottom;

a solid throat panel arranged on the open bottom of the main hood and extending from a front edge of the main hood towards a rear edge of the main hood such that the throat panel and the main hood are cojoined at an angle and define an inner space therebetween, wherein the throat panel is arranged below the perforations of the main hood and is configured to partially cover the open bottom of the main hood leaving a venting opening in a rear portion of the open bottom of the main hood, the venting opening configured to be arranged over the opening on the roof deck; and an interior panel, comprising a rear end attached to and extending from the main hood and a free, front end, wherein the interior panel extends within the inner space between the main hood and the throat panel, and further wherein the front end of the interior panel is spaced apart from the throat panel and the main hood, the interior panel comprising perforations extending therethrough.

2. The roof ventilation device of claim 1, wherein the venting opening of the main hood extends from a rear edge of the throat panel to the rear edge of the main hood.

3. The roof ventilation device of claim 2, wherein the throat panel comprises an interior baffle configured to at least partially block outside air entering through the perforations of the main hood from flowing towards the venting opening of the main hood.

4. The roof ventilation device of claim 3, wherein the interior baffle extends from the rear edge of the throat panel.

5. The roof ventilation device of claim 2, wherein a left side of the main hood is closed by a left-side panel and a right side of the main hood is closed by a right-side panel.

6. The roof ventilation device of claim 5, wherein each one of the left-side panel and right-side panel comprises a face portion and a side flange extending from the face portion.

7. The roof ventilation device of claim 1, wherein the main hood comprises a rear portion and a front portion, wherein the front portion of the main hood is a solid wall comprising the perforations of the main hood, and the rear portion of the main hood is a non-perforated solid wall.

8. The roof ventilation device of claim 7, wherein the rear portion is convex and rearward-sloped and the front portion is convex and frontward-sloped.

9. The roof ventilation device of claim 7, wherein the rear portion of the main hood is reinforced with at least one reinforcement rib.

10. The roof ventilation device of claim 1, wherein the perforations in at least one of the main hood and the throat panel are formed by a roll forming process.

11. The roof ventilation device of claim 1, wherein each perforation of the perforations in at least one of the main hood and the throat panel is provided with a respective C-shaped bridge portion extending over said each perforation, the bridge portion defining front and rear openings.

12. The roof ventilation device of claim 1, wherein the perforations in at least one of the main hood and the throat panel are formed as louvers.

13. The roof ventilation device of claim 1, further comprising a front flange extending frontward from the front edge of the main hood, the front flange configured to rest on the roof deck.

14. The roof ventilation device of claim 13, wherein the front flange comprises an upward bend.

15. The roof ventilation device of claim 1, further comprising a rear flange extending rearward from a rear side of the main hood, the rear flange configured to rest on the roof deck.

16. The roof ventilation device of claim 1, wherein the perforations of the interior panel are shaped the same as the perforations of the main hood.

17. The roof ventilation device of claim 1, wherein each perforation of the interior panel comprises a respective bridge portion extending over said each perforation, the respective bridge portion oriented towards the throat panel.

18. The roof ventilation device of claim 1, wherein each perforation of the main hood comprises a respective bridge portion extending over said each perforation, the respective bridge portion oriented outwardly of the main hood.

19. An off-ridge roof ventilation device for placing on an opening of a roof deck, comprising:

a main hood configured to cover an opening on a roof deck, the main hood comprising perforations and an open bottom, wherein a left side of the main hood is closed by a left-side panel and a right side of the main hood is closed by a right-side panel;

a throat panel arranged on the open bottom of the main hood and extending from a front edge of the main hood towards a rear edge of the main hood such that the throat panel and the main hood are cojoined at an angle and define an inner space therebetween, wherein the throat panel is arranged below the perforations of the main hood and is configured to partially cover the open bottom of the main hood leaving a venting opening in a rear portion of the open bottom of the main hood, wherein the venting opening extends from a rear edge of the throat panel to the rear edge of the main hood and is configured to be arranged over the opening on the roof deck; and an interior panel, comprising a rear end attached to and extending from the main hood and a free, front end, wherein the interior panel extends within the inner space between the main hood and the throat panel, and further wherein the front end of the interior panel is spaced apart from the throat panel and the main hood, the interior panel comprising perforations extending therethrough.

20. An off-ridge roof ventilation device for placing on an opening of a roof deck, comprising:

a main hood configured to cover an opening on a roof deck, the main hood comprising a rear portion and a front portion, wherein the front portion of the main hood is a convex, frontward-sloped solid wall provided with perforations, and the rear portion is a convex, rearward-sloped non-perforated solid wall, wherein a left side of the main hood is closed by a left-side panel and a right side of the main hood is closed by a right-side panel;

a throat panel arranged on the open bottom of the main hood and extending from a front edge of the front portion of the main hood towards a rear edge of the main hood such that the throat panel and the front portion of the main hood are cojoined at an angle and define an inner space therebetween, wherein the throat panel is arranged below the perforations of the main hood and is configured to partially cover the open bottom of the main hood leaving a venting opening in the open bottom of the main hood, wherein the venting opening extends from a rear edge of the throat panel to the rear edge of the main hood and is configured to be arranged over the opening on the roof deck; and an interior panel, comprising a rear end attached to and extending from the main hood and a free, front end, wherein the interior panel extends within the inner space between the main hood and the throat panel, and further wherein the front end of the interior panel is spaced apart from the throat panel and the main hood, the interior panel comprising perforations extending therethrough; wherein the perforations in the main hood and the throat panel are formed as louvers.

* * * * *